US005117745A

United States Patent [19]

Prochnow et al.

[11] Patent Number: 5,117,745

[45] Date of Patent: Jun. 2, 1992

[54] SAFETY LOCK

[75] Inventors: Kenneth E. Prochnow; Richard C. Burke, both of Madison, Wis.

[73] Assignee: Carnes Company, Inc., Verona, Wis.

[21] Appl. No.: 489,487

[22] Filed: Mar. 6, 1990

[51] Int. Cl.[5] ..... F24F 13/062

[52] U.S. Cl. ..... 454/300; 24/295; 454/292

[58] Field of Search ..... 98/40.05, 40.07, 40.12, 98/40.13, 40.21; 292/80, 87, 303; 16/73; 24/295, 336

[56] References Cited

U.S. PATENT DOCUMENTS

| | | | |
|---|---|---|---|
| 2,537,930 | 1/1951 | Hall | 24/295 X |
| 2,689,027 | 9/1954 | Flora | 24/295 X |
| 2,891,461 | 6/1959 | O'Day | 98/40.13 |
| 3,110,242 | 11/1963 | O'Day | 98/40.13 |

FOREIGN PATENT DOCUMENTS

| | | | |
|---|---|---|---|
| 2247360 | 5/1975 | France | 16/73 |

*Primary Examiner*—Harold Joyce

*Attorney, Agent, or Firm*—Michael, Best & Friedrich

[57] ABSTRACT

A safety spring lock for locking an air pattern control in a diffuser includes a normally bowed strip carrying a retainer clip. The strip is flattened to engage the clip with a fixed part of the diffuser, the clip engages the diffuser and that engagement and the inherent bias of strip hold the spring lock in place in the diffuser. The safety lock includes a U-shaped portion spaced from the retainer clip and connected to the retainer carrying portion by a normally bowed strip which is flexed to a flattened position to locate the U-shaped portion adjacent to portion of the movable air pattern conrol when it part of the diffuser. The U-shaped portion is urged into engagement with a portion of the air pattern control to prevent movement thereof in the diffuser which would otherwise be sufficient to remove the air pattern control from the diffuser.

18 Claims, 2 Drawing Sheets

SAFETY LOCK

BACKGROUND OF THE INVENTION

This invention relates to apparatus such as diffusers as used, for example, in air distribution systems.

Such diffusers typically include a base plate which mates with an air distribution duct. A pattern control assembly is attached to the base plate to influence the discharge of air from the system into the room or other area being supplied.

Among the objects of this invention is to provide for secure attachment between the pattern control assembly and the base plate, while accommodating selective attachment and detachment of the pattern control assembly from the base plate.

SUMMARY OF THE INVENTION

For the achievement of these and other objects, this invention proposes a safety spring clip arrangement which is operative selectively to lock the pattern control of the diffuser in the diffuser assembly and to release the pattern control for removal.

More particularly, the spring clip includes a first area or portion which carries a retaining clip insertable into an opening formed in base plate. The portion of the spring clip carrying the retainer is configured such that in inserting the retaining clip into the opening it is deformed producing an inherent bias which, coupled with the engagement between the retainer and the base plate, holds the retainer in the opening. The spring clip also includes a locking portion spaced from the retainer which, when that mounting portion is engaged with base plate of the diffuser, is engageable with the mounting portion of the diffuser pattern control to lock that mounting portion in place but is removable to release the pattern control from the base plate.

Preferably, the spring clip includes a body having first, second, and third areas spaced longitudinally one from the other. A first area of the body has a preset, generally bowed configuration and is flexible from that bowed configuration. When flexed from that preset configuration, it has an inherent bias tending to return it to the bowed configuration. A retainer is provided at the first area and includes first and second lips. Each lip has a portion thereof attached to the first area and a free end. The free ends are spaced relative to each other and said first area with at least one of the lips having an extension along the first area body. A base member includes an opening having opposed edges which are spaced apart a preselected distance less than the distance between said first and second lip ends of said retainer. The base member has a configuration different from the configuration of the first area of the body. The body is flexed toward the base member and the retainer is positioned in the base member opening with one lip positioned so that one of the edges of the opening is positioned intermediate the free end thereof and the end thereof attached to the first area body. The free end of the second lip is adjacent the other one of the opening edges for engagement therewith. Another of the three body areas has a generally U-shaped configuration defined by first and second legs extending in a common direction and a bight portion connecting the legs to form the closed end of the U. Preferably, a projection extends laterally from one of the legs of the U. The base member includes another opening having opposed edges the spacing between which is greater than the spacing between said first and second legs of said U so that the U-shaped end is receivable in that opening. The third of the areas in the body connects the first area and the U-shaped area. That third area has a body which is generally bowed and is flexible from that bowed configuration. When so flexed, it has an inherent bias tending to return to the bowed configuration. The U-shaped area is receivable in and can be removed from the second opening. When in the opening, one leg is adjacent one of the edges the second opening and the lateral projection overlaps the base member. The lateral projection is positioned to engage and limit movement of the pattern control such that it cannot be removed from the diffuser.

Other objects and advantages will be pointed in, or be apparent from, the specification and claims as will obvious modifications of the embodiment shown in the drawings, in which:

DESCRIPTION OF THE PREFERRED EMBODIMENT

The invention is described as embodied in an air distribution system, one of the principal applications of the invention.

The diffuser includes a base plate 10. The base plate carries a duct collar 12. This collar connects with an air distribution duct (not shown).

Figure 1:
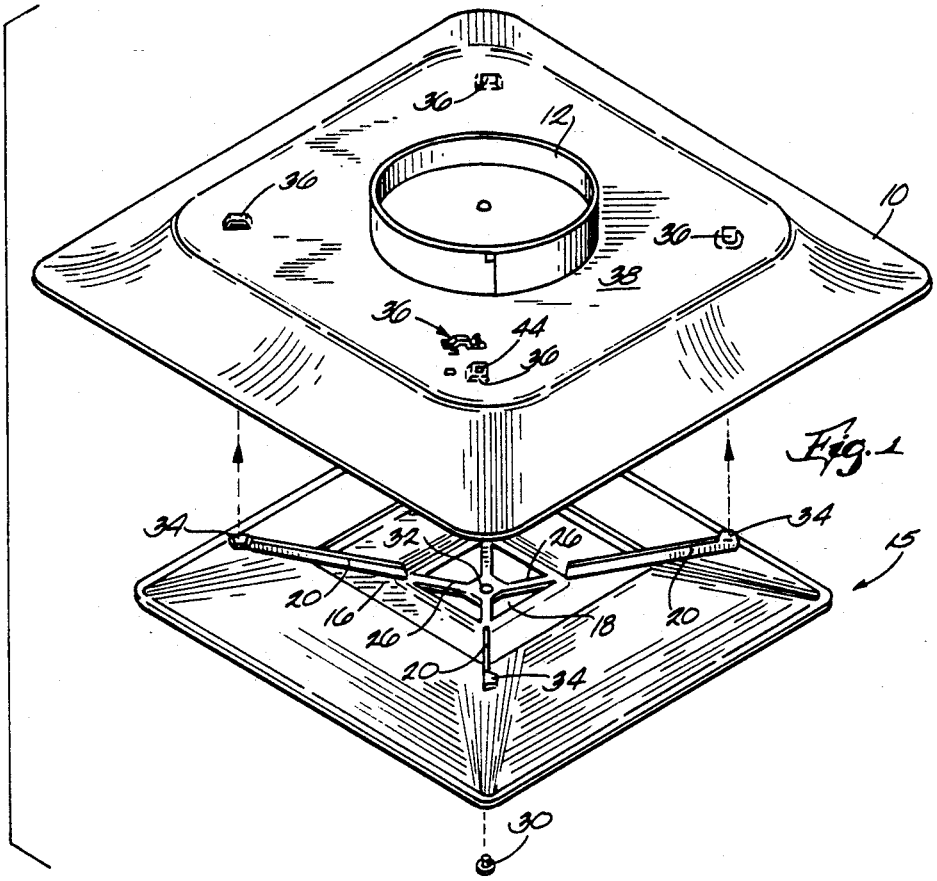
FIG. 1 is an exploded view of the pattern control and base plate of the diffuser.
Figure 2:
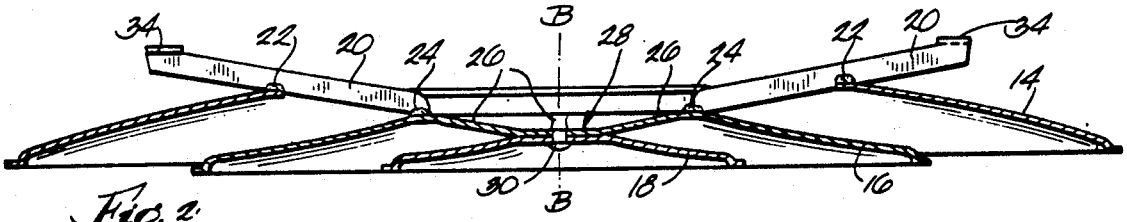
FIG. 2 is a section view taken along line A-A in FIG. 3.
Figure 3:
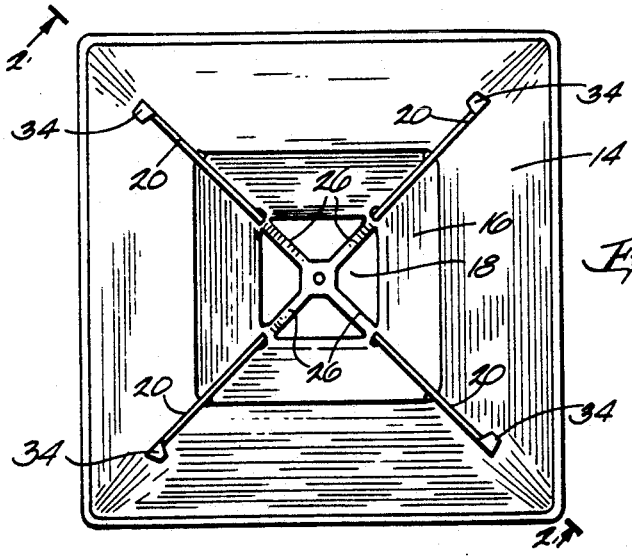
FIG. 3 is a plan view of the exposed side of the pattern control.

In the illustrated embodiment, the air pattern control 15 is in the form of a series square cones 14, 16, and 18. The cones are arranged on the same axis, B—B in FIG. 2. Cones 14, 16 and 18 are connected by four identical struts 20. More specifically, cones 14 and 16 are connected by a strut 20 by, for example, spot welds at points 22 and 24, or some other suitable form of connection. The cone assembly is completed by ribs 26 formed as a part of cone 16 and attached to inner cone 18 by spot welds 28 where projection 30 extends through opening 32 in the middle cone 16.

Each of the four struts has a turned tab 34 at the free end thereof. Base plate 10 has four offset areas, i.e. offset relative to the plane of the central body 38 of the base plate. The offsets 36 are formed from the body 38 so as to provide an opening 40 at each offset. One tab 34 fits into each opening 40 and overlaps a portion of the offset face 42 of each area 36 and a portion of central body 38, see FIG. 5.

One of the offsets 36 is provided with an opening 44. Another opening 46 is also provided in the central body 38 adjacent that particular offset. The purpose of these openings is to receive a safety spring clip 48. The spring clip locks the cone pattern assembly in place so that it cannot be accidentally or inadvertently removed. Before describing the structure and function of the safety clip, some general comments as to the overall diffuser will help in the understanding of the purpose of the safety lock.

The primary function of the diffuser obviously is to effectively discharge air into the room being serviced. In addition it should aesthetically blend with the wall surfaces and beyond that it should be reliable in a safety sense as well as operationally. The parts making up the diffuser should be securely held in place while permitting partial disassembly, as required, for maintenance, cleaning, replacement and/or repair of otherwise concealed equipment. Such equipment could be volume control dampers, fire and smoke dampers and/or detectors, temperature sensors, etc. The safety lock is concerned with these desirable characteristics of the diffuser.

Figure 5:
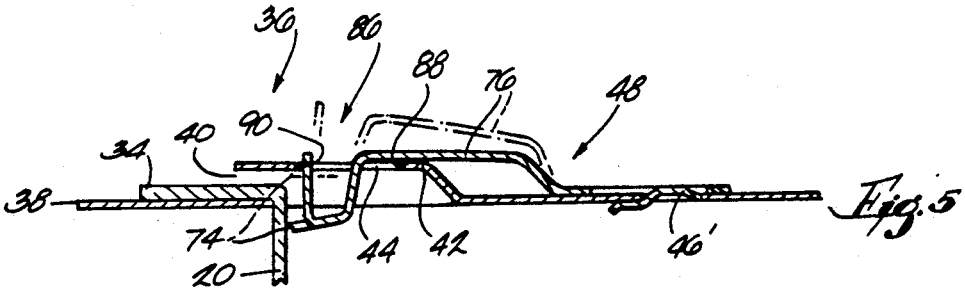
FIG. 5 is an enlarged view of the spring clip retainer and a portion of the base plate and pattern control.
Figure 4:
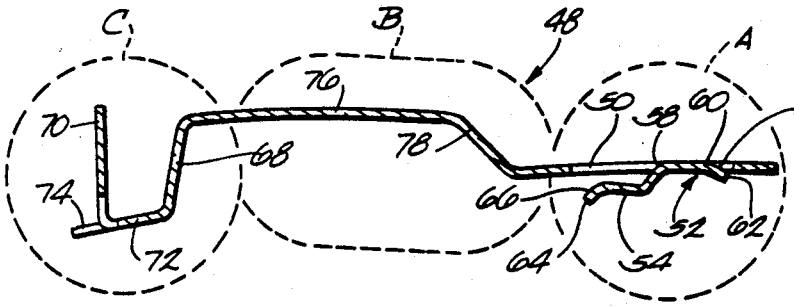
FIG. 4 is an enlarged view of the spring clip retainer.

The spring clip is best illustrated in FIGS. 4 and 5. It is metallic and has three basic areas, A, B, and C. Area A has a body portion 50 which is generally bowed. With reference to the previously mentioned plane of the central body 38 of the base plate 10, body 50 will bow upwardly from the base plate. The function of this bowed configuration will be discussed later.

A retainer 52 is included as part of area A. The retainer includes two lips 54 and 56. These lips are preferably formed integrally with body 50 in that they are suitably punched from the body material. As a result, each lip has an inner end 58 and 60 attached to body 50 and a free end 62 and 64. The free ends 62 and 64 are spaced from each other and laterally from body 50. End 64 is part of an angled surface 66 for reasons which will be explained later.

Area C is generally U-shaped, being made up of two legs 68 and 70 extending in a common direction and being generally parallel. The legs 68 and 70 are connected by a bight portion 72 to complete the U-shape. A lip 74, preferably lanced from leg 70, projects laterally from the U-shaped end as as an extension of the closed end of the U-shaped end.

Area B connects areas A and C and includes an elongated portion 76 extending from the free end of leg 68. It also includes a portion 78 extending at an angle from portion 76 to body 50 of Area C. Portion 76, similar to body 50, is bowed relative to the previously mentioned plane of base member 38.

As can be seen in FIGS. 4 and 5, the spring clip is generally elongated and areas A, B and C are relatively spaced along the longitudinal axis thereof.

The assembly of the spring clip onto the base member 38 will now be described.

Figure 6:
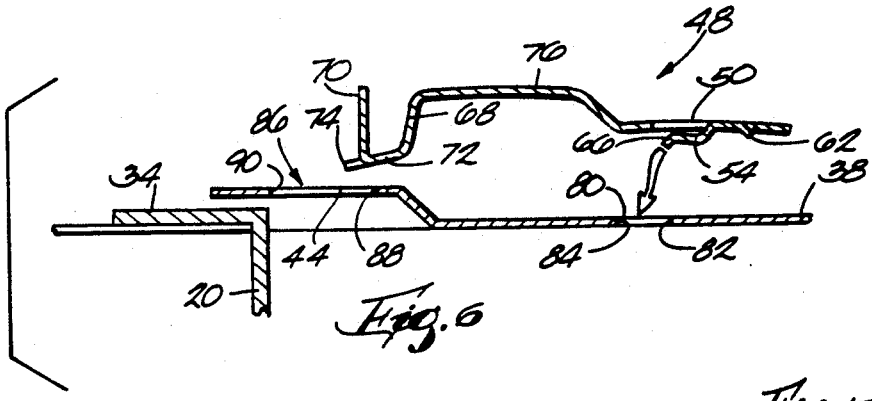
FIG. 6 is an enlarged view of a portion of the base plate and pattern control and the spring clip detached to better illustrate how the parts are assembled.

A portion of the base member is illustrated in FIGS. 5 and 6, as is the end of one of the struts 20 and a tab 34. Base member 38 includes an opening 80 (see FIG. 6). Opening 80 has two opposed edges 82 and 84, which are spaced apart a distance less than the distance between the ends 62 and 64 of lips 54 and 56. Spring clip 52 is inserted into opening 80 by sliding lip 54 under edge 84 until end 62 of lip 56 is positioned at edge 82 for engagement therewith. Angle surface 66 and the fact that lip 54 is spaced laterally from the body assist in this positioning of lip 54. Edge 84 of the opening is positioned intermediate the ends of lip 54, with a portion of that lip overlapping the base member (see FIG. 5). With that overlap and end 62 engaging edge 82, the spring clip is held in the opening and in the process body 50 is flattened into engagement with the base member, the inherent bias in the body 50, which tends to return the body to its bowed configuration, provides a spring force holding the spring clip in this assembled relation.

At the other end of spring clip, area C is associated with an opening 86 in the offset area 36. The opposed edges 88 and 90 of the opening are spaced apart a distance greater than the spacing between legs 68 and 70, including the projection 74, so that the U-shaped end can be inserted into opening 86. When that end is inserted in the opening connecting portion 76 will be flattened. Its inherent bias tends to return itself to the bowed configuration (the dotted line position in FIG. 5) and urges the projection 74 into engagement with strut 20 thereby holding the portion 76 against return to its normal position and tab 34 against removal from opening 40. That, in turn, securely holds the entire pattern control, cones 14, 16 and 18, assembled to base member 38. However, when it is desired to remove the pattern control assembly, either for substitution of a different pattern control or maintenance on the diffuser or the system which requires access through the diffuser, the spring clip can be easily removed to clear the tab for withdrawal from the opening 40. This is accomplished by pressing the U-shaped end to the right and upward, as viewed in the drawings, moving the projection 74 away from strut 20, bowing connecting portion 76, and allowing the U-shaped end to be moved up through the opening 86.

Figure 7:
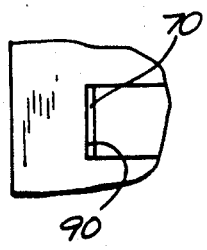
FIG. 7 is a top view of a portion of the spring clip and one of the openings into which it fits.

The width of leg 70 is generally equal to the width of edge 90, and correspondingly the width of the U-shaped end and opening 86 are generally equal as seen in FIG. 7, to provide a block off preventing unwanted flow where that function is desired.

Figure 8:
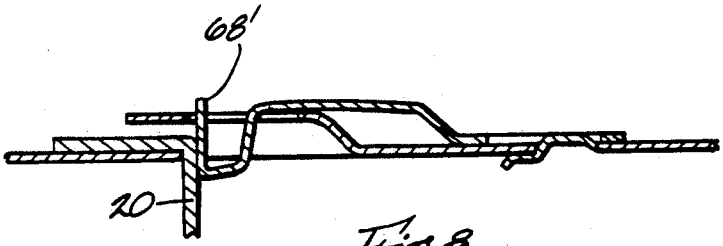
FIG. 8 is an enlarged view of an alternative embodiment.

FIG. 8 shows an alternative embodiment wherein projection 74 has been eliminated and it is the leg 68' which is positioned to limit movement of the strut 20. The use of projection 74 is preferred as it insures a positive engagement with the pattern control and reduces possible vibration with attendant noise if there was not a positive engagement with the pattern control. The vibration could be produced by air passing over a base mounted pattern control.

In addition, projection 74 prevents complete removal of the U-shaped end from the opening 86 by being engageable with the underside of the offset surface adjacent edge 90 (see the dotted line showing in FIG. 5). The amount of the offset forming opening 40 is such that the height of opening 40 is greater than the combined thickness of tab 34 and projection 4. This clears the tab 34 for removal from opening 40 without complete disengagement of the spring clip, a feature which simplifies removal and reattachment.

Although this invention has been illustrated and described in connection with a particular embodiment thereof, it will be apparent to those skilled in the art that various changes and modifications may be made therein without departing from the spirit of the invention or the scope of the appended claims.

We claim:

1. An assembly comprising a base member, support means on said base member, a fixture including mounting means selectively movable toward and away from said support means for selectively and alternatively engaging said support means to support said fixture from said base member and disengaging said support means to release said fixture from said base member, and a safety lock, said safety lock including an elongated body including first, second, and third areas spaced longitudinally one from the other, said first area in said body having an extension characterized by a preset, generally bowed configuration, and said first area in said body being flexible from said bowed configuration and having an inherent bias tending to return to said bowed configuration when flexed from said bowed configuration, a retainer connected to said first area and including first and second lips, each of said lips having a portion thereof fixed to said first area and extending away form said portions of attachment to a free end, said free ends spaced relative to each other, at least one of said lips extending from said fixed portion thereof to said free end thereof along said body and being laterally spaced from said body when said first area is both bowed and flexed from said bowed configuration, said base member including means defining opposed edges which are spaced apart a preselected distance less than the distance between the free ends of said first and second lips and defining an opening between said opposed edges, said base member having a configuration in the area of said opening different from said bowed configuration of said first area of said body, said first area in said body being positionable adjacent said base member at said opening and being capable of flexure toward and conformance with the configuration of said base member and said retainer being receivable in said opening in said base member so that said one lip is positioned with one of said opposed edges intermediate the free end thereof and the portion thereof fixed to said first area and with the free end of said second lip generally in engagement with the other of said opposed edges, said second area in said body having a generally U-shaped configuration defining first and second legs extending in a common direction and a bight portion connecting said legs and forming the closed end of said U, said first and second legs being spaced apart in the direction of the longitudinal spacing between said three body areas, said safety lock also including a projection extending outwardly from one of said legs of said U, said base member including means adjacent said support, means for defining third and fourth generally opposed edges spaced to define an opening therebetween, the spacing between said third and fourth edges being greater than the spacing between said first and second legs of said U, said third area of said body connecting said first and second areas and having a body which has a preset generally bowed configuration and being flexible from said bowed configuration, said third area when flexed from said bowed configuration having an inherent bias tending to return to said bowed configuration, and said U-shaped area being receivable in and removable from said second opening in said base member with said one leg adjacent one of said third or fourth edges and with said projection adjacent said fixture mounting means, the inherent bias of said third area urging said projection toward engagement with said fixture mounting means to limit movement of said fixture mounting means relative to said base member to prevent release of said fixture from said base member.

2. The assembly of claim 1 wherein said fixture is an air discharge pattern control, said support means on said base member include plural openings spaced relative to each other on said base member, said mounting means includes plural tabs one receivable in each of said base member openings, and said safety lock is positioned at and is operatively associated with one of said tabs.

3. The assembly of claim 2 wherein said air discharge pattern control comprises a plurality of members arranged generally symmetrically about an axis, said mounting means includes plural struts and means connecting said struts to said plurality of pattern control members, said struts radiating from said axis and carrying said tabs so that rotation of said pattern control generally about said axis moves said tabs into and out of engagement in said support means openings.

4. The assembly of claim 3 wherein said safety lock elongated body extends generally parallel to a tangent to the arc of movement of said pattern control about said axis.

5. The assembly of claim 2 wherein said one of said plural openings included in said support means is provided by an offset portion of said base member and said opening between said third and fourth edges is provided in said offset, said one of said plural openings is dimensioned larger than said tab, and said projection is movable from engagement with said one of said tabs into engagement with one of said third or fourth edges so that said tab is removable from said opening and will not be engaged by said projections.

6. The assembly of claim 1 wherein said opening between said third and fourth edges has a width dimension and the width dimension of said U-shaped area is generally equal to the width dimension of said opening.

7. An assembly comprising a base member, support means on said base member, a fixture including mounting means selectively movable toward and away from said support means for selectively and alternatively engaging said support means for support said fixture from said base member and disengaging said support means to release said fixture from said base member, and a safety lock, said safety lock including an elongated body including first, second, and third areas spaced longitudinally one from the other, said first area in said body having an extension characterized by a preset, generally bowed configuration, said first area in said body being flexible from said bowed configuration and having an inherent bias tending to return to said bowed configuration when flexed from said bowed configuration, and a retainer connected to said first area and including first and second lips, each of said lips having a portion thereof attached to said first area and extending away from said portions of attachment to a free end, said free ends spaced relative to each other, at least one of said lips extending from said fixed portion thereof to said free end thereof along said first body area and being laterally spaced from said first body area when said first area is both bowed and flexed from said bowed configuration, said base member including means defining opposed edges which are spaced apart a preselected distance less than the distance between the free ends of said first and second lips and defining an opening between said opposed edges, said base member having a configuration in the area of said opening different from said bowed configuration of said first area of said body, said first area in said body being positionable adjacent said base member at said opening and being capable of flexure toward and conformance with the configuration of said base member and said retainer being receivable in said opening in said base member so that said one lip is positioned with one of said opposed edges intermediate the free end thereof and the portion thereof attached to said first area and with the free end of said second lip generally in engagement with the other of said opposed edges, said second area in said body including a generally U-shaped portion defining first and second legs extending in a common direction and a bight portion connecting said legs and forming the closed end of said U, said base member including means adjacent said support means for defining a second opening therebetween, said third area in said body connecting said first and second areas and having a body which is generally bowed and being flexible from said bowed configuration, said third area when flexed from said bowed configuration having an inherent bias tending to return to said bowed configuration, and said U-shaped portion being receivable in and removable from said second opening in said base member with one leg thereof adjacent said fixture mounting means and being urged toward said fixture mounting means by the inherent bias of said third area to limit movement of said fixture mounting means relative to said base member to prevent release of said fixture from said base member.

8. The assembly of claim 7 wherein said fixture is an air discharge pattern control, said support means on said base member include plural openings spaced relative to each other on said base member, said mounting means includes plural tabs one receivable in each of said base member openings, and said safety lock is positioned at and is operatively associated with one of said tabs.

9. An assembly comprising a base member, support means on said base member, a fixture including mounting means selectively movable toward and away from said support means for selectively and alternatively engaging said support means to support said fixture from said base member and disengaging said support means to release said fixture from said base member, and a safety lock, said safety lock including an elongated body including first and second areas spaced longitudinally one from the other, said first area in said body having a preset, normal configuration and being flexible from said normal configuration and having an inherent bias tending to return to said normal configuration when flexed therefrom, and a retainer connected to said first area and including first and second lips, each of said lips having a portion thereof attached to said first area and extending away from said portions of attachment to a free end, said free ends spaced relative to each other, at least one of said lips extending from said fixed portion thereof to said free end thereof along said first body area and being laterally spaced from said first body area when said first body area is both in its normal configuration and deflected from said normal configuration, said base member including means defining opposed edges which are spaced apart a preselected distance less than the distance between the free ends of said first and second lips and defining an opening between said opposed edges, said base member having a configuration in the area of said opening different from said normal configuration of said first area of said body, said first area of said body being positionable adjacent said base member at said opening and being capable of flexure toward and conformance with the configuration of said base member and said retainer being receivable in said opening in said base member so that said one lip is positioned with one of said opposed edges intermediate the free end thereof and the portion thereof attached to said first area and the free end of said second lip generally in engagement with the other of said opposed edges, said second area in said body having a surface spaced from said first area in the direction of the longitudinal spacing between said body areas, and means for connecting said first and second areas so that said surface is adjacent said fixture mounting means and biasing said surface toward engagement with said fixture mounting means to limit movement of said fixture mounting means relative to said support means on said base member to prevent release of said fixture from said base member.

10. A diffuser comprising, in combination, a base member, an air discharge pattern control, means for supporting said pattern control on said base member and for movement independent of said base member for release from said base member, and a safety spring lock supported on said base member adjacent a portion of said pattern control for selective engagement therewith to limit movement of said pattern control relative to said base member to prevent release thereof from said base member, said safety spring lock including a first flexible portion carrying a retainer, said first flexible portion being deformable from a normal position to engage said retainer with said base member and when deformed exerting an inherent bias tending to return said first flexible portion to said normal position, said retainer engaging said base member to prevent said return movement of said first flexible portion so that said retainer and said inherent bias maintain said safety spring lock in engagement on said base member, and said safety spring lock including a second portion positioned adjacent said pattern control and being flexible from a first position to a second position, and when so flexed to said second position exerting an inherent bias tending to return to said first position and urging said second portion toward limiting function, said engagement with said pattern control preventing return movement to said first position but said second portion being further flexible to release said second portion from engagement with said pattern control and for movement to said first position.

11. A safety lock for use in an assembly including a base member having a base portion including a first configuration and an opening, and a fixture removeably supported on the base member, said safety lock comprising:

a first portion assembled to the base member, said first portion including a body portion having a normal configuration different from the first configuration of the base portion and being flexible from said normal configuration to create an inherent bias tending to return said body portion to said normal configuration, and a retainer connected to said body portion and adapted to be received in the opening, said body portion being flexed to conform to the first configuration of the base portion when said retainer is received in the opening so that said inherent bias provides a spring force which cooperates with said retainer to hold said first portion in assembled relation on the base member;

a second portion adapted to engage the fixture and positionable between a first position wherein removal of the fixture from the base member is permitted and a second position; and a third portion interconnecting said first and second portions, said third portion being flexible to position said second portion in said second position, and when so flexed exerting an inherent bias tending to return said second portion to said first position and urging said second portion toward engagement with said fixture to prevent removal of said fixture from said base member, said engagement with said fixture preventing return of said second portion to said first position, and said third portion being further flexible to release said second portion from engagement with said fixture to permit return of said second portion to said first position.

12. A safety lock as set forth in claim 11 wherein the base portion is generally planar and said body portion is generally bowed when in said normal configuration.

13. A safety lock as set forth in claim 11 wherein the opening is defined by a pair of opposed edges, wherein said retainer includes a first and second lips, each of said lips having a portion thereof attached to said body portion and extending away from said portion of attachment to a free end, said free ends being spaced relative to each other, one of said lips extending from said fixed end thereof to said free end thereof along said body portion and laterally spaced from said body portion, and wherein said retainer is receivable in the opening so that said one lip is positioned with one of the opposed edges intermediate the free end thereof and the portion thereof attached to said body portion, and the free end of said second lip engages the other of the opposed edges.

14. A safety lock for use in an assembly including a base member and a fixture removeably supported on the base member, said safety lock comprising:

a first portion assembled to the base member;

a second portion adapted to engage the fixture and positionable between a first position wherein removal of the fixture from the base member is permitted and a second position; and a third portion interconnecting said first and second portions, said third portion having a generally bowed configuration and being flexible from said bowed configuration to facilitate movement of said second portion between said first and second positions, and said third portion when said flexed exerting an inherent bias tending to return said third portion to said bowed configuration, tending to return said second portion to said first position and urging said second portion toward engagement with said fixture to prevent removal of said fixture from said base member, said engagement with said fixture preventing return of said second portion to said first position, and said third portion being further flexible to release said second portion from engagement with said fixture to permit return of said second portion to said first position.

15. An assembly comprising:

a base member including a base portion having therein an opening, said base portion having a first configuration;

a fixture removeably supported on said base member; and a safety lock including a first portion assembled to said base member, said first portion including a body portion and a retainer connected to said body portion and receivable in said opening, said body portion having a normal configuration different from said first configuration and said body portion being flexible from said normal configuration to create an inherent bias tending to return said body portion to said normal configuration, and said body portion being flexed to conform to the configuration of said base portion when said retainer is received in said opening so that said inherent bias provides a spring force which cooperates with said retainer to hold said first portion in assembled relation on said base member, a second portion engageable with said fixture and positionable between a first position wherein removal of said fixture from said base member is permitted and a second position, and a third portion interconnecting said first and second portions, said third portion being flexible to position said second portion in said second position, and when so flexed exerting an inherent bias tending to return said second portion to said first position and urging said second portion toward engagement with said fixture to prevent removal of said fixture from said base member, said engagement with said fixture preventing return of said second portion to said first position, and said third portion being further flexible to release said second portion from engagement with said fixture to permit return of said second portion to said first position.

16. An assembly as set forth in claim 15 wherein said base portion is generally planar and said body portion is generally bowed when in said normal configuration.

17. An assembly as set forth in claim 15 wherein said retainer includes first and second lips, each of said lips having a portion thereof attached to said body portion and extending away from said portion of attachment to a free end, said free ends being spaced relative to each other, one of said lips extending from said fixed end thereof to said free end thereof along said body portion and laterally spaced from said body portion, and wherein said retainer is receivable in said opening so that said one lip is positioned with one of said opposed edges intermediate the free end thereof and the portion thereof attached to said body portion, and the free end of said second lip engages the other of said opposed edges.

18. An assembly comprising:

a base member;

a fixture removeably supported on said base member; and a safety lock including a first portion assembled to said base member, a second portion engageable with said fixture and positionable between a first position wherein removal of said fixture from said base member is permitted and a second position and a third portion interconnecting said first and second portions, said third portion having a generally bowed configuration and being flexible from said bowed configuration to facilitate movement of said second portion between said first and second positions, and said third portion when said flexed exerting an inherent bias tending to return said third portion to said bowed configuration, tending to return said second portion to said first position and urging said second portion toward engagement with said fixture to prevent removal of said fixture from said base member, said engagement with said fixture preventing return of said second portion to said first position, and said third portion being further flexible to release said second portion from engagement with said fixture to permit return of said second portion to said first position.

* * * * *